US005080146A

United States Patent [19]

Arasteh

[11] Patent Number: 5,080,146

[45] Date of Patent: Jan. 14, 1992

[54] METHOD AND APPARATUS FOR FILLING THERMAL INSULATING SYSTEMS

[75] Inventor: Dariush K. Arasteh, Oakland, Calif.

[73] Assignee: The United States of America as represented by the United States Department of Energy, Washington, D.C.

[21] Appl. No.: 325,743

[22] Filed: Mar. 20, 1989

[51] Int. Cl.[5] ..... B65B 31/04

[52] U.S. Cl. ..... 141/4; 141/64; 141/243; 156/109; 156/286; 156/356; 156/382; 53/403; 53/432

[58] Field of Search ..... 141/1, 4, 8, 37, 63, 141/64, 54, 56, 237, 242, 243; 156/109, 286, 356, 382; 428/34; 53/510, 927, 403, 432, 88, 86; 73/52; 128/202.13, 206.12, 206.21, 206.24, 205.25, 202.22, 200.24, 206.24

[56] References Cited

U.S. PATENT DOCUMENTS

| | | | |
|---|---|---|---|
| 541,929 | 7/1895 | Greer | 141/8 |
| 2,138,164 | 11/1938 | Haven | 154/28 |
| 2,435,747 | 2/1948 | Larson | 226/20 |
| 2,815,621 | 12/1957 | Carter | 141/56 |
| 2,875,792 | 3/1959 | Moyer | 53/510 |
| 3,683,974 | 8/1972 | Stewart et al. | 141/4 |
| 4,180,426 | 12/1979 | Oustin et al. | 156/104 |
| 4,231,202 | 11/1980 | Dube | 52/743 |
| 4,369,084 | 1/1983 | Lisec | 156/286 |
| 4,393,105 | 7/1983 | Kreisman | 428/34 |
| 4,625,494 | 12/1986 | Iwatschenko et al. | 53/510 |
| 4,780,164 | 10/1988 | Rueckheim et al. | 156/109 |
| 4,886,095 | 12/1989 | Lisec | 141/4 |
| 4,909,874 | 3/1990 | Rueckheim | 156/286 |

*Primary Examiner*—Ernest G. Cusick
*Attorney, Agent, or Firm*—L. E. Carnahan; Roger S. Gaither; William R. Moser

[57] ABSTRACT

A method for filling insulated glazing units is disclosed. The method utilizes a vacuum chamber in which the insulated glazing units are placed. The insulated glazing units and vacuum chamber are evacuated simultaneously. The units are then refilled with a low conductance gas such as Krypton while the chamber is simultaneously refilled with air.

16 Claims, 2 Drawing Sheets

METHOD AND APPARATUS FOR FILLING THERMAL INSULATING SYSTEMS

The Government has rights in this invention pursuant to Contract No. DE-AC03-76SF00098 awarded by the U.S. Department of Energy.

BACKGROUND OF THE INVENTION

The present invention relates generally to thermal insulating systems and more specifically to a method for filling insulated glazings.

The use of insulation, weather stripping and other energy conserving products in the construction and renovation of buildings has successfully reduced the energy required for heating and cooling such buildings by impeding the transmission of heat through walls, floors, and roofs. However, even with the construction and use of highly insulated buildings, much energy is unnecessarily wasted in heating and cooling due to heat transmission through windows.

The earliest response to this problem was the development of double glazed windows (R2 - a thermal resistance of 2 hr-ft$^2$-deg F/BTU) to replace single glazed (R1) windows. Such thermal window assemblies are usually constructed by placing sealed, insulated glazing ("IG") units having the desired number of glazing layers in conventional window frames. "IG" is used in the art to refer to insulated glass units; however, because the applicants foresee glazing as being comprised of materials other than glass, the term "IG" units when used herein will not refer to a specific material but to insulated glazing units generally. While the addition of further glazing layers to the IG unit provides a moderate gain in insulating performance, it also adds weight and bulk to the window and reduces the transmission of light.

Since radiative transfer is a significant portion of heat transfer in a typical multi-glazed window, low emittance coatings have been developed which reflect long wavelength infrared energy and reduce window heat transfer. The addition of a low-emittance (low-E) coating to a double glazed IG unit provides the thermal efficiency of triple glazing (R3) without the additional weight, bulk and complexity.

Further improvements have been made possible by the addition of a low conductance gas to the space between the low-E glazings to reduce the other major component of heat transfer - conductive/convective heat transfer. For example, U.S. Pat. Nos. 4,459,789 and 3,683,974 disclose the use of various fluorocarbon gases, known collectively by the trademark "Freon," in a sealed window assembly. U.S. Pat. No. 4,393,105 teaches of the use of argon and krypton to serve this purpose.

Conventional methods for filling the space between glazings in IG units, however, are generally wasteful. For example, the method described in U.S. Pat. No. 3,683,974 teaches that gas be introduced through a single opening between the glass panes. As the gas enters the interior space, air is displaced into the outside environment.

Another method involves the use of two openings, one at the top and the other at the bottom of the unit being filled. Gas is slowly injected through the bottom opening to prevent turbulence, pushing air out of the top opening. After the air has been substantially displaced, the filling process is ceased and the holes are plugged.

The above described processes only result in gas/air mixtures of about 80–90% gas. Higher percentage fills are difficult to achieve without structural damage to the glazings or a significant waste of gas and time. Further, these methods are inefficient, causing substantial losses of gas. It is not uncommon for a loss of more than 50% of the gas filling the volume of the space between glazings to occur.

With the current demand for "super windows" that use krypton or other expensive gases, there is a need for a more efficient method of filling IG units. A vacuum chamber can be used during the evacuation and refill process to accomplish this purpose. For example, U.S. Pat. No. 4,393,105 discloses the use of a housing containing a controlled environment where gas fill of the thermal IG units occurs. The method described, however, requires that the housing, as well as the IG units be filled with the gas mixture. Thus, significant amounts of gas must be used. This is undesirable when costly gases are used to fill IG units. Accordingly, there is a need for a more efficient method of filling these units.

SUMMARY OF THE INVENTION

An object of the subject invention is to provide an efficient method of attaining high percentage gas fills without inducing structural damage to the IG unit.

Another object of the present invention is to provide a method for filling gas impermeable containers with a minimum amount of waste.

Another object of the present invention is to provide an apparatus for filling gas impermeable containers with gas with a minimum amount of waste.

Other objects of the invention will become readily apparent to those skilled in the art from the following description and the accompanying drawings.

DETAILED DESCRIPTION OF THE INVENTION

The present invention provides a method and apparatus for filling insulated glazings and other gas impermeable containers using commercially available materials.

The fabrication of an improved R5-R10 IG unit is described in U.S. patent application Ser. No. 07/178,043, filed on Apr. 5, 1988, of which I am a co-inventor, and which is incorporated herein by reference. It is to be understood that this IG unit is disclosed for exemplary purposes only and that the subject invention is suitable for use with a variety of gas impermeable containers.

Figure 1:
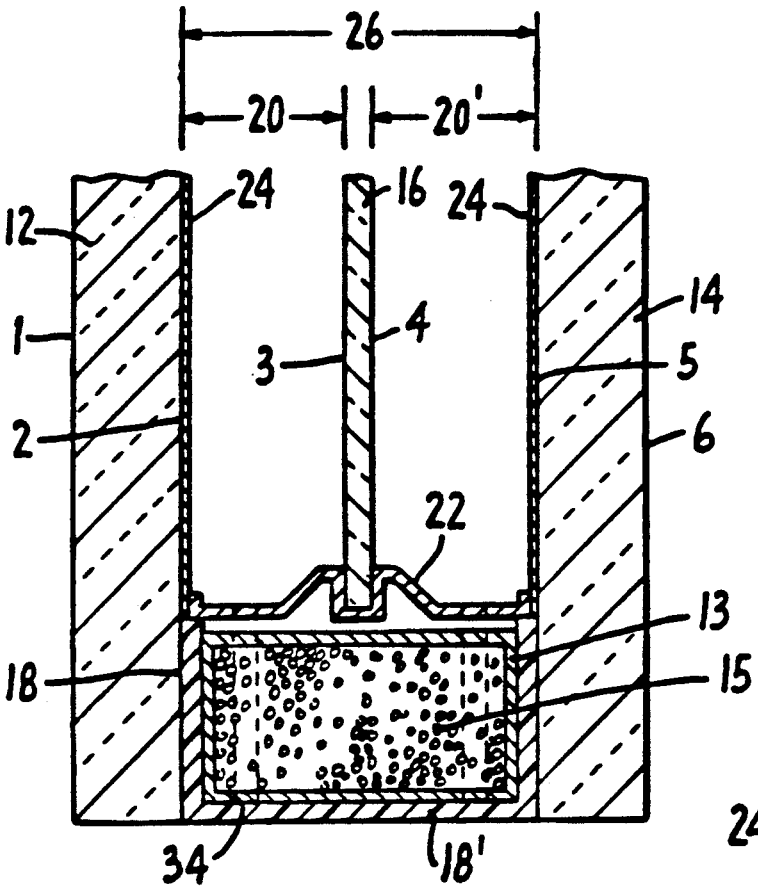
FIG. 1 is a sectional side view of a triple glazed IG unit for use with the present invention having low emissivity coatings on the center-facing surfaces of the inner and outer glazing.
Figure 2:
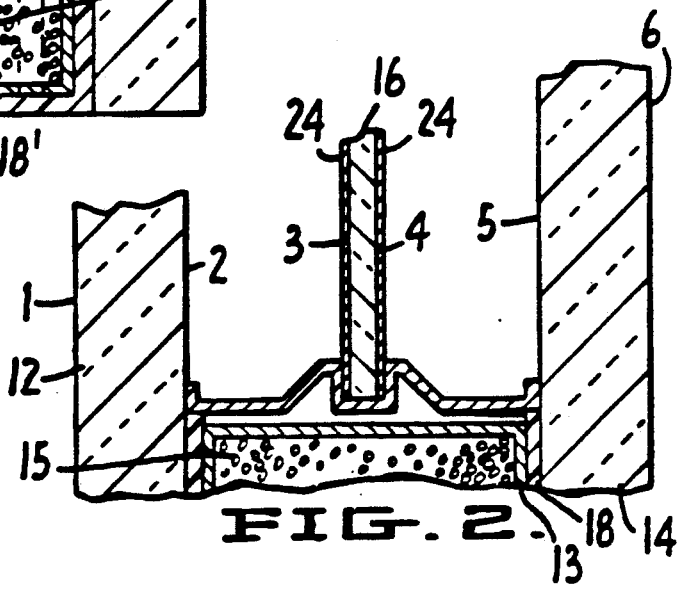
FIG. 2 is a sectional side view of a triple glazed IG unit for use with the present invention having low emissivity coatings on both surfaces of the middle glazing.

FIGS. 1 and 2 illustrate one of those tripleglazed IG units suitable for use with the present invention. Outer glazing 12, and inner glazing 14 are sealed to opposite ends of spacer 13, using one or more appropriate gas impermeable sealants 18, 18', such that the center-facing surfaces 2 and 5 face each other. By convention, "inner" refers to the direction of the room or interior of the building and "outer" refers to the direction of the outdoors or exterior of the building. The glazing surfaces are numbered according to convention by looking at the window from the outside in. Thus, the surface of the outer glazing 12 facing the exterior of the building is surface 1, the center-facing surface of outer glazing 12 is surface 2, the surface of middle glazing 16 which faces outer glazing 12 is surface 3, the surface of middle glazing 16 which faces inner glazing 14 is surface 4, the center-facing surface of inner glazing 14 is surface 5, and the surface of inner glazing 14 facing the interior of the building is surface 6.

Between the center-facing surfaces 2, 5 respectively of the glazings 12, 14 is mounted at least one thin, rigid middle glazing 16. Middle glazing 16 forms a first thermal gap 20 between outer glazing 12 and middle glazing 16, and a second thermal gap 20' between inner glazing 14 and middle glazing 16. Contrary to conventional triple-glazed designs, this middle glazing 16 does not add to the structural integrity of the unit. Thus, the middle glazing need not be intimately sealed to the spacer 13 and need not seal the two thermal gaps 20, 20' from each other since small spaces of less than about 1/16 of an inch will not contribute significantly to convection and may simplify the process of assembly and gas filling.

Spacer 13 will generally be filled with a desiccant 15 which will keep the sealed interior of the I.G. unit dry. The middle glazing 16 can be held in place by simple mechanical means such as edge support 22. Clips, grooves, or any other devices which will keep the glazing stationary may also be used. If materials with a potential for creep (such as plastic) are used for middle glazing 16, such materials could be suspended from the top edge.

A low emissivity (low-E) coating is highly preferred on at least one glazing surface inside each thermal gap 20, 20'. The methods for coating glass using low-E coatings are described in "Low-E: Piecing Together the Puzzle", by Julie Dolenga, *Glass Maoazine*, March 1986, pp. 116–131, which is incorporated herein by reference.

The final step in completing a thermal IG unit requires filling the gas impermeable space 26 with an inert, low conductance gas. Suitable low conductance gases include one or more of the noble gases such as argon, krypton, or xenon. Other suitable gases include but are not limited to $CO_2$, $SF_6$, fluorocarbons or mixtures of these gases with or without air.

Figure 3:
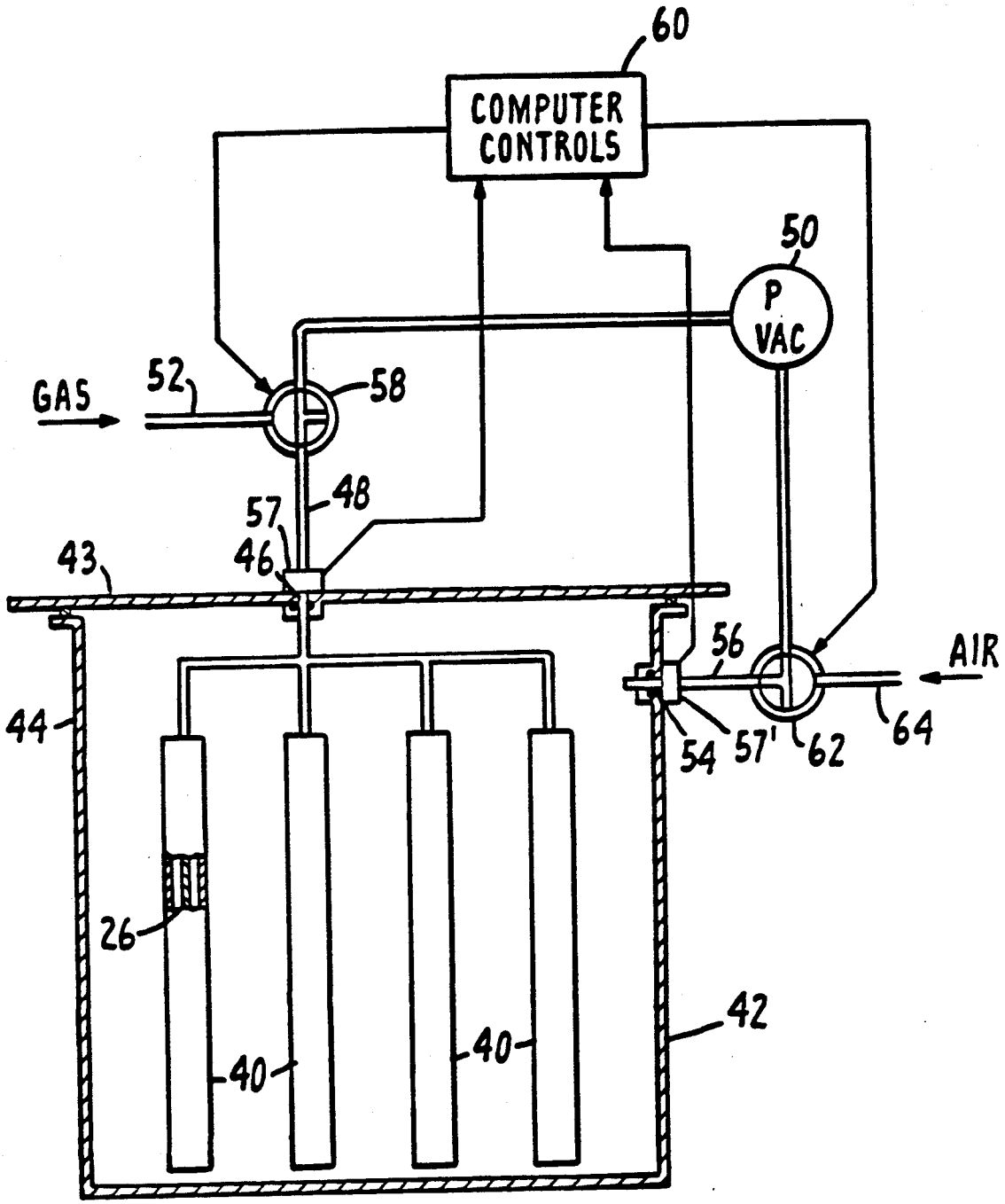
FIG. 3 is a sectional view of the subject invention showing IG units in a vacuum chamber used for air evacuation and gas refilling.

The desired gas is introduced into the gas impermeable space 26 via the following method. As illustrated in FIG. 3, one or more IG units 40 are placed within a vacuum chamber 42. Vacuum chamber 42 has a removable cover 43 to facilitate placement of the IG units 40 therein. Removable cover 43 must be adapted to seal the vacuum chamber after it is placed thereon. This can be accomplished by using vacuum grease, an o-ring or other seal, or any other conventional method known in the art.

The IG units 40 can be held vertically in vacuum chamber 42 via slots (not shown), racks or any other conventional means well known in the art. Alternatively, the IG units 40 can be held in a horizontal position within chamber 42. The IG unit 40, as shown in FIG. 1, includes one or more sealable conduits 34 which extend from the outside of the spacer 13 to the gas impermeable space 26 inside. The removable cover 43 or wall 44 of vacuum chamber 42 also includes one or more gas refill apertures 46 extending therethrough. A first hose or line 48 fits through sealable conduit 34 and is connected to vacuum pump 50 and a first gas source 52, respectively. Hose 48 is connected to each IG unit being filled. In the preferred embodiment, vacuum chamber 42 also includes at least one chamber aperture 54 through which a second hose 56 extends. Hose 56 is in communication with vacuum pump 50 and a second gas source 64.

Before gas is added to the IG unit 40, the IG unit 40 and vacuum chamber 42 are evacuated to substantially remove all the air present. Time for evacuation varies from several seconds to several minutes depending on the vacuum pump used, the size of the vacuum chamber and the number of IG units within the chamber. For instance, a vacuum chamber of approximately 30"×30"×6" holding one IG unit will take approximately 90 seconds to evacuate to an air concentration near zero. Evacuation of the IG unit 40 and vacuum chamber 42 should occur substantially simultaneously so as to maintain approximately the same pressure throughout the entire system in order to avoid damage to the IG unit due to pressure differentials between the unit and the chamber.

After evacuation, the IG unit 40 and chamber 42 are separately refilled with two different gases. Separate refilling is desireable, as an insulating gas, such as krypton, is only needed for the IG unit rather than both the unit and the chamber. Refilling should also occur substantially simultaneously to avoid damage to the IG units as explained above. The IG units 40 are filled through the first hose 48 for a predetermined amount of time, depending on the size and number of the units present in the vacuum chamber and the gas used. Filling time will vary depending upon chamber geometry and controls, but will typically be on the order of several minutes. The units are filled to slightly above atmospheric pressure to ensure that no air enters the units when the conduits 34, shown in FIG. 1, are sealed.

A pressure sensor 57 can be associated with a three-way valve 58 and first hose 48. Valve 58 has three positions: a first position allowing evacuation by defining a conduit between the end of first hose 48 and vacuum pump 50, a second position for gas refilling wherein a second conduit is defined between the end of the first hose 48 and a first gas source 52, and a third closed position. An electronic control 60, such as a computer chip or other suitable electronic circuit, can be placed in communication with the pressure sensor used to read the pressure in the first hose 48 and adjust the valve 58 accordingly. For example, after the IG unit and chamber have been sufficiently evacuated, controller 60 would direct the valve 58 into the refill position to allow gas to flow into the IG unit 40. Similarly, after sufficient gas has been placed into the IG unit, central controller 60 would direct the valve 58 into the closed position.

The vacuum chamber 42 is simultaneously refilled with a different gas, preferably air, through second hose 56 which is in communication with a second gas source 64. Alternatively, if air is used, air can be collected from the surrounding environment directly and fed into second hose 56. The use of air or another inexpensive gas avoids the unnecessary use of the more costly gases used in the IG unit while preventing significant pressure differences between the chamber and IG unit thus avoiding damage to the unit. Second hose 56 is also connected to a three way chamber valve 62 which is also controlled by central controller 60 as described above. A pressure sensor 57' may also be associated with second hose 56 and three way valve 62 to enable control 60 to determine the pressure in the chamber 42.

Yet another alternative to the refill procedure for use with krypton mixtures would be to fill the IG unit with a mixing gas such as argon, using the procedure described above and to then pump in a predetermined amount of krypton. If the desired krypton percentage is on the order of 60% to 70%, it is expected that all the krypton added will stay in the IG unit.

After filling with the insulating gas, the IG unit is sealed using any appropriate gas impermeable sealant such as silicone, butyl rubber, polyurethane or polysulfide. Because this is essentially a closed system, i.e. the gas never contacts the atmosphere except when the vacuum and gas refill line 48 to the IG unit 40 is removed and the window sealed, the gas loss fraction is as little as 1%.

Although the subject method of gas fill has been disclosed with reference to a triple glazed window, it should be understood that such a process is easily adaptable for use with other IG units.

While the preferred embodiment of the present invention has been illustrated and described in detail, various modifications of, for example, components, materials and parameters, will become apparent to those skilled in the art, and it is intended to cover in the appended claims all such modifications and changes which come within the scope of this invention.

What is claimed is:

1. An improved method for filling a gas impermeable container with gas comprising the steps of:

(a) placing said gas impermeable container into a vacuum chamber;

(b) substantially simultaneously evacuating said vacuum chamber and said gas impermeable container so as to maintain approximately the same pressure within the vacuum chamber including inside the gas impermeable chamber;

(c) separately and substantially simultaneously refilling said gas impermeable container with a first different gas and said vacuum chamber with a second gas so as to maintain approximately the same pressure within the vacuum chamber including inside the gas impermeable chamber; and (d) sealing said gas impermeable container to prevent the escape of said first gas.

2. The method of claim 1 wherein said vacuum chamber and said gas impermeable container are evacuated to substantially completely remove any air present.

3. The method of claim 1 wherein said second gas is air.

4. The method of claim 1 wherein said gas impermeable container comprises an insulated glazing unit with a gas impermeable space.

5. The method of claim 4 wherein said insulated glazing unit is refilled with at least one insulating gas and said vacuum chamber is refilled with air.

6. The method of claim 5 wherein said insulating gas is selected from the group consisting of argon, krypton, xenon, $CO_2$, air, $SF_6$, and a fluorocarbon gas.

7. The method of claim 6 wherein said vacuum chamber and said insulated glazing unit are evacuated through evacuation lines extending outside said vacuum chamber.

8. In a gas filling apparatus comprising a vacuum chamber, a vacuum pump, a first gas source, a second gas source, and a first and second hose passing from the outside of the vacuum chamber to the inside, said first hose having a first end inside the vacuum chamber, said first hose being adapted to selectively open a first conduit between the first end of the first hose and the vacuum pump and then to close the first conduit and to open a second conduit between the first end of the first hose and the first gas source, said second hose having a first end inside the vacuum chamber, said second hose being adapted to selectively open a first conduit between the first end of the second hose and the vacuum pump and then to close the first conduit and to open a second conduit between the first end of the second hose and the second gas source, an improved method for filling a gas impermeable space between glazings in a multi-glazed insulated glazing unit with a first gas, and the vacuum chamber with a second different gas, said method comprising the steps of:

(a) operatively connecting the first end of the first hose to the insulated glazing unit to open a conduit between the first end of the first hose and the gas impermeable space of the insulated glazing unit;

(b) sealing the insulated glazing unit in the vacuum chamber;

(c) opening the first conduit in both the first hose and second hose to substantially simultaneously evacuate the vacuum chamber and the gas impermeable space of the insulated glazing unit so as to maintain approximately the same pressure within the vacuum chamber including inside the gas impermeable chamber;

(d) closing the first conduit and opening the second conduit in both the first hose and second hose to substantially simultaneously fill the gas impermeable space of the insulated glazing unit with the first gas and fill the vacuum chamber with the second different gas so as to maintain approximately the same pressure within the vacuum chamber including inside the gas impermeable chamber;

(e) opening the vacuum chamber; and, (f) removing the first end of the first hose from the insulated glazing unit, plugging the insulated glazing unit and sealing the insulated glazing unit with a gas impermeable seal to prevent the escape of the first gas from the gas impermeable space.

9. The method of claim 8 wherein said insulated glazing unit is refilled with at least one insulating gas and said vacuum chamber is refilled with air.

10. The method of claim 9 wherein said insulating gas is selected from the group consisting of argon, krypton, xenon, $CO_2$, air, $SF_6$, and a fluorocarbon gas.

11. An apparatus for filling a gas impermeable container comprising:

a vacuum chamber having a removable cover which is adapted to seal the vacuum chamber;

a vacuum pump;

a first hose passing from the outside of the vacuum chamber to the inside, said first hose having a first end inside the vacuum chamber, said first end being adapted to open a conduit to the interior of the gas impermeable container, said first hose being adapted to selectively open a first conduit between the first end of the first hose and the vacuum pump and then to close the first conduit and to open a second conduit between the first end of the first hose and a first gas source;

a second hose passing from the outside of the vacuum chamber to the inside, said second hose having a first end inside the vacuum chamber, said second hose being adapted to selectively open a first conduit between the first end of the second hose and the vacuum pump and then to close the first conduit and to open a second conduit between the first end of the second hose and a second gas source; and, a means for controlling the opening and closing of the first and second conduits in the first and second hoses, such that evacuation of the vacuum chamber and the gas impermeable container occurs substantially simultaneously when the first conduits of the first and second hoses are opened, and such that the gas impermeable container is filled with a first gas and the vacuum chamber is filled with a second different gas when the first conduits are closed and the second conduits are opened.

12. The apparatus of claim 11 in which the first and second hoses are adapted to open the first and second conduits using solenoid actuated valves.

13. The apparatus of claim 11 in which the chamber additionally includes a means for supporting the gas impermeable container.

14. The apparatus of claim 11 in which the gas impermeable container is an insulated glass unit for thermal windows.

15. The apparatus of claim 11 additionally including a means for sensing the pressure of the gas in the chamber.

16. The apparatus of claim 15 in which the means for controlling the opening and closing of the first and second conduits is an electronic control operatively attached to the means for sensing the pressure of the gas in the chamber.

* * * * *